United States Patent [19]

Gerjets

[11] 4,311,398

[45] Jan. 19, 1982

[54] PRINTER FOR PRODUCING UNIFORMLY SPACED CHARACTERS

[75] Inventor: Heinz Gerjets, Wilhelmshaven, Fed. Rep. of Germany

[73] Assignee: Olympia Werke Ag, Wilhelmshaven, Fed. Rep. of Germany

[21] Appl. No.: 121,721

[22] Filed: Feb. 15, 1980

[30] Foreign Application Priority Data

Feb. 17, 1979 [DE] Fed. Rep. of Germany ..... 2906135

[51] Int. Cl.[3] ..... B41J 1/30; B41J 19/30; B41J 29/36

[52] U.S. Cl. ..... 400/70; 400/144.2; 400/322; 400/697; 400/903

[58] Field of Search ..... 400/61, 62, 70, 144.2, 400/310, 322, 320, 328, 696, 697, 697.1, 902, 903

[56] References Cited

U.S. PATENT DOCUMENTS

| | | | |
|---|---|---|---|
| 3,306,416 | 2/1967 | Dahlin et al. | 400/134.2 |
| 3,861,512 | 1/1975 | Coriasco et al. | 400/162.2 |
| 4,030,591 | 6/1977 | Martin et al. | 400/144.2 |
| 4,119,384 | 10/1978 | Keiter | 400/144.2 |

*Primary Examiner*—Paul T. Sewell
*Attorney, Agent, or Firm*—Spencer & Kaye

[57] ABSTRACT

A printer for use in an office machine having a keyboard and including a typing element carrying type faces of the characters to be printed and mounted on a carriage for displacement along a line printing path and being rotatable to bring a selected type face into a printing position, and a control device responsive to signals from the keyboard and operative, immediately after a type face is brought into the printing position and before printing of the associated character, for effecting rotation of the typing element in a predetermined direction over a path of predetermined length and then in the direction opposite to the predetermined direction and over a path of the same predetermined length. Similarly, when the office machine is equipped with a lift-off tape and a correction key for removing characters printed incorrectly, the control device is arranged to displace the carriage to a location one step removed from the location of the character to be removed in the normal line printing direction and, upon subsequent actuation of the correction key, to displace the carriage by a selected number of steps opposite to the line printing direction and then in the line printing direction by one less than the selected number of steps to the location of the character to be removed, prior to application of the type face to the carrier medium.

9 Claims, 7 Drawing Figures

PRINTER FOR PRODUCING UNIFORMLY SPACED CHARACTERS

BACKGROUND OF THE INVENTION

The present invention relates to a printer for printing lines of characters in which the characters are uniformly spaced in typewriters and similar office machines.

Printers of the type contemplated by the invention generally include a carriage, a carriage drive supporting the carriage for movement along a line printing path, a typing element, or type carrier, carrying type faces of the characters to be printed and movably mounted on the carriage, a typing element drive motor connected to the typing element and controllable from the keyboard for displacing the typing element in steps to bring a selected type face into a printing position, a type striking device positioned to act on the type face in the printing position to effect printing of the associated character on a record carrier medium, and a control device connected to receive signals from the keyboard, to derive therefrom driving pulses identifying each character to be printed, and to transmit those driving pulses to the typing element drive motor for bringing successive selected type faces to the printing position.

In order to obtain neatly printed copy with the characters spaced apart as uniformly as possible, it is known, in typewriters having type carriers that are driven by, for example, a summing drive, to have the type carrier cooperate with a centering device. This centering device serves the purpose of aligning the type carrier for the final printing position and of holding it in this centered position until the particular character has been printed. The final alignment of the type carrier by the centering device occurs only after the type carrier has been rotated by the summing drive into the desired orientation, dictated by the character to be printed.

Such centering device is required also because known summing drives are unable to perform the desired rotary setting of the type carrier with absolute precision since, due to the plurality of individual parts involved, there always occurs significant tolerance deviations, or play. Moreover, during the setting process, torsional vibrations occur in the type carrier setting shaft and elastic deformations occur in the setting drive, both having a great influence on the type carrier and thus making accurate setting of the type carrier impossible.

The prior art, on the other hand, also includes arrangements employing servo or stepping motor drives in which the type carrier can be moved from an initial position into a desired position in either direction of rotation. In order for the type carrier to reach the desired position as quickly as possible, it is advisable to select the shortest setting path.

These reversible drives for setting the type carrier have the drawback that the positioning accuracy exhibits a large hysteresis due to the fact that the setting may be effected from different directions. The positioning accuracy is also influenced greatly by the angle of rotation which the type carrier must traverse when it is set from an old position to a new position.

A centering device that may be provided must therefore be able to align the type carrier within this large hysteresis, which involves a certain amount of time and requires the expenditure of much force. In printers without centering devices it is impossible to produce neatly printed material with uniformly spaced characters due to the great hysteresis involved.

SUMMARY OF THE INVENTION

It is an object of the present invention to produce neatly printed text in a typewriter or similar office machine, even those having printers without centering devices for the typing element with always uniformly spaced characters.

Another object of the invention is to achieve, even in printers in which the typing element is arranged to be set from different directions over the shortest path of rotation, a minimum hysteresis for the positioning accuracy.

These and other objects are achieved, according to the invention, in a printer having the structure described at the outset, by arranging the control device such that, immediately after each movement of the typing element to bring a type face into the printing position and before printing of the associated character, it applies to the drive motor at least one driving pulse for displacing the typing element in a predetermined direction over a path of predetermined length and thereafter at least one driving pulse for displacing the typing element in the direction opposite to the predetermined direction and over a path of the same predetermined length, whereby, prior to each printing operation, the typing element performs a pilgrim step-type movement having a fixed pattern.

The printer according to the present invention thus makes it possible to obtain printed text with uniformly spaced characters since the typing element, after being set, always performs a movement which can be described as a type of pilgrim step which always starts in the same direction and with the same length of step.

According to preferred embodiments of the invention, the typing element is fixed to the output shaft of the drive motor and the control device is a microprocessor operative to cause each successive movement of the typing element to be effective over the shortest possible path from the previous position thereof. This provides for a simple control of the typing element. The control device may be constituted, within the scope of the present invention, by a known control element employing ring counters, a bit pattern generator, etc.

In typewriters with an erasing system, it is also necessary that the position of the typing element carriage, when the faulty character is lifted off by means of a lift-off tape, coincide precisely with the position which the typing element had while printing the original character. Even a lateral deviation of 1/100 mm will leave an outline of the original character which is narrow but clearly visible.

Therefore it is important that the carriage driven by the motor be always set very precisely.

This is accomplished, according to the invention, in a printer as described above and further provided with a correcting device actuatable by a correction key on the office machine keyboard and including a lift-off tape for removing a previously printed character by applying the type face of that character to the record carrier medium with the lift-off tape interposed therebetween, with the control device being connected for supplying drive pulses to the carriage drive, each pulse being effective to displace the carriage by one step along the line printing path, with one direction of displacement being the normal line printing direction, in that, for removing a printed character, the control device is arranged to displace the carriage to a location one step removed from the location of the character to be removed in the line printing direction and, upon subsequent actuation of the correction key, to supply a given number of drive pulses to the carriage drive for displacing the carriage by a corresponding number of steps opposite to the line printing direction and to then supply to the carriage drive at least one drive pulse one less in number than the given number for displacing the carriage in the line printing direction to the location of the character to be removed, prior to application of the type face to the carrier medium, whereby, prior to each lift-off operation, the carriage performs a pilgrim step-type movement having a fixed pattern. This assures that the erroneously printed character is lifted completely from the record carrier.

DESCRIPTION OF THE PREFERRED EMBODIMENTS

Figure 1:
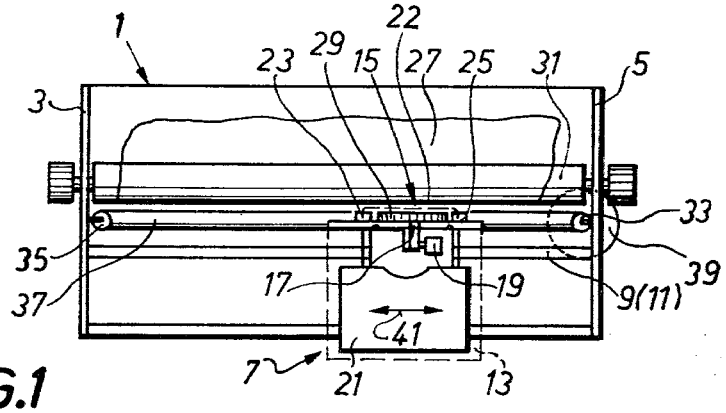
FIG. 1 is a simplified top plan view of a preferred embodiment of the present invention.

FIG. 1 is a top view of a daisy wheel printer 1 according to the invention having side walls 3 and 5 between which a carriage 7 is mounted for longitudinal displacement on shafts 9 and 11, shaft 11 being located behind shaft 9. The carriage 7 includes a base plate 13 carrying a type wheel drive arrangement 15 and a type striking device composed of a printing hammer 17 and an electromagnet 19. A type wheel 29 is rotatably mounted on arrangement 15. On the base plate 13 there is also disposed a ribbon cassette 21 with a ribbon 22 which passes, by means of guides 23 and 25, between a record carrier medium, i.e. a paper sheet, 27 and the rotatably mounted type wheel 29, The record carrier medium 27 is driven in a known manner by means of a platen 31 which itself is driven via a motor (not shown). In the side walls 3 and 5 there are rotatably mounted two driving gears 33 and 35 which rotate about vertical axes and cooperate in a form-locking manner with a toothed belt 37 one reach of which is permanently connected to the carriage 7. The gear 33 can be driven in both directions 41 for moving carriage 7 along platen 31 in a stepwise manner via a motor, e.g. a stepping motor 39.

Figure 2:
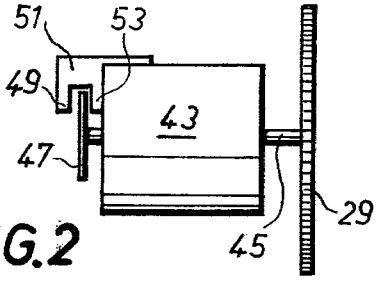
FIG. 2 is a side elevational detail view of a portion of the structure of FIG. 1.

The typing element includes the type wheel 29 provided with a plurality of elastic type arms with type faces of the characters arranged at their free ends. Referring to FIG. 2, type wheel 29 can be rotated in steps by means of a motor, e.g. a stepping motor 43, which can be operated in a start-stop manner. Wheel 29 is fastened to one end of the shaft 45 of motor 43 and at the other end of the driven motor shaft 45 there is provided an optical coding disc 47 which cooperates with a light source 49 and a plurality of light-sensitive receiving elements 53 disposed in a housing 51 carried by motor 43.

Figure 3:
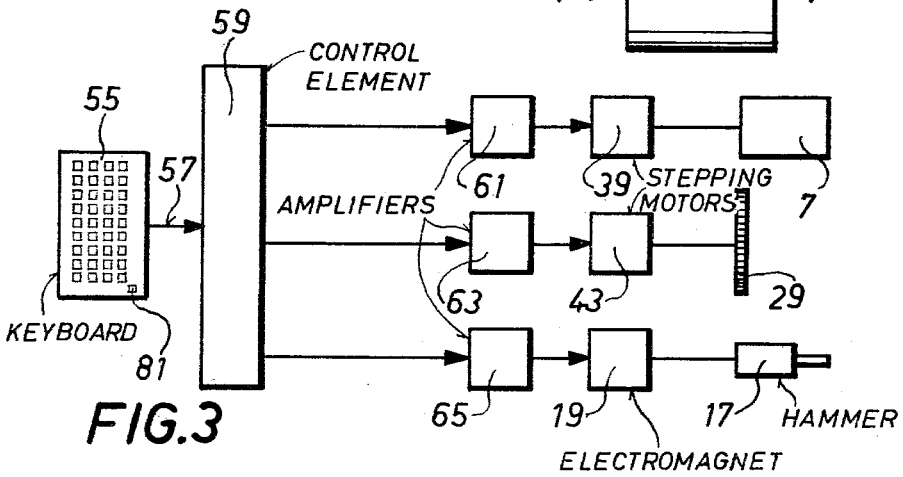
FIG. 3 is a block circuit diagram for one embodiment of a control device according to the invention.

As shown in FIG. 3, signals 57 coded to correspond to characters to be printed are conducted from a keyboard 55 to a control element 59 which may be a microprocessor or a commercially available computer. The control element 59 receives the data, performs certain calculations and sends driving pulses via amplifiers 61 and 63 to the carriage stepping motor 39 and to the type wheel stepping motor 43. When the carriage stepping motor 39 has been supplied with six driving pulses, the carriage, which is advanced with a 1/12 inch pitch, will have moved on by one character space. The type wheel stepping motor 43 requires four driving pulses to rotate the type wheel through an angle equal to the type arm spacing. The electromagnet 19 for the hammer 17 likewise receives its driving pulses via an amplifier 65 from the control element 59.

In order to obtain neatly printed material with uniformly spaced characters, the type wheel stepping motor 43 can be controlled, via the control element 59 serving as the control device, in such a manner that, after the type carrier 29 has been set to the character to be printed, one or a plurality of further driving pulses in a predetermined direction and thereafter the same number of pulses in the opposite direction are given to the type wheel stepping motor 43 in such a way that the type carrier 29, immediately before printing the selected character by the action of hammer 17, performs a type of pilgrim step movement always in the same direction and always with the same length of step.

Figure 4:
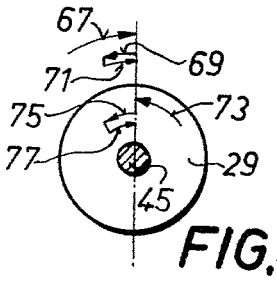
FIGS. 4 and 5 are detail views illustrating two forms of movement according to the invention.

Referring to FIG. 4, after the type wheel 29 is brought, for example, from an old set position in the direction of arrow 67, into the printing position, the type wheel is caused to execute a pilgrim step movement, first in the direction of arrow 69 and then in the direction of arrow 71. If the type wheel has been brought into the printing position in the direction of arrow 73, the type wheel thereafter performs the same pilgrim step movement in the directions of arrows 75 and 77.

Due to the pilgrim step movements of the type carrier, the same stopping conditions are always created since, immediately preceding the printing process, the type disc is always brought into the printing position by being moved in the same direction and with the same length of step. For that reason a neat printed copy with uniformly spaced characters is always assured. The hysteresis of the resulting positioning accuracy is so small, even if the type disc 29 is initially positioned by movement in the opposite directions 67 and 73, that a possibly required additional positioning can be performed with very little force by a centering device.

The Keiter U.S. Pat. No. 4,119,384 which issued on Oct. 10, 1978, discloses a disk printer with a centering device.

The individual parts of such a centering device may therefore be made of very light-weight materials which also has a favorable effect on the centering speed.

To correct an incorrectly printed character by renewed striking with the intermediary of a lift-off, or correcting, tape it is necessary for the carriage 7 to always return to precisely the position it was in when the character was printed if the lift-off is to be perfect. Accurate positioning of the carriage 13 is of course also necessary if the individual characters are to be spaced uniformly.

Figure 5:
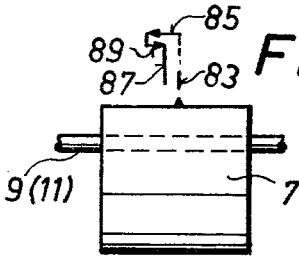

For a possibly required correction process, the carriage 7 is first moved, for example by actuating a back-up key on the keyboard 55, by means of the carriage drive motor 39 opposite to the direction of printing until it reaches one switching step, or character space, after, i.e. to the right of, the correction position. Then a correction key 81 in the keyboard 55 is actuated to cause the control element 59 to emit a number "n" of backing pulses and thereafter a number "n−1" of advancing pulses to the carriage stepping motor 39 in such a way that before each erasing process the carriage 13 performs the type of pilgrim step movement depicted in FIG. 5, always in the same direction and always with the same length of step.

To this end, the carriage 7 is first brought into the position 83 which is one back-up step removed from the correction position. After actuation of the correction key, the carriage 13 is moved from position 83 by "n" back-up pulses along path 85 beyond the correction position and is then moved along the path 89 by "n−1" advancing pulses to reach the correction position 87. With this pilgrim step movement which is performed by the carriage 13 in the same direction and with the same length of step during each correction process, the stopping condition for the carriage 13 is always the same. This makes it possible to completely lift the incorrectly printed character from the record carrier 27. The device according to the invention thus makes it possible to provide a neat printed copy with characters which are always uniformly spaced.

The Martin et al U.S. Pat. No. 4,030,591 is a typical prior art printer with a control device which could be modified to operate according to the invention.

Figures 6, 7:
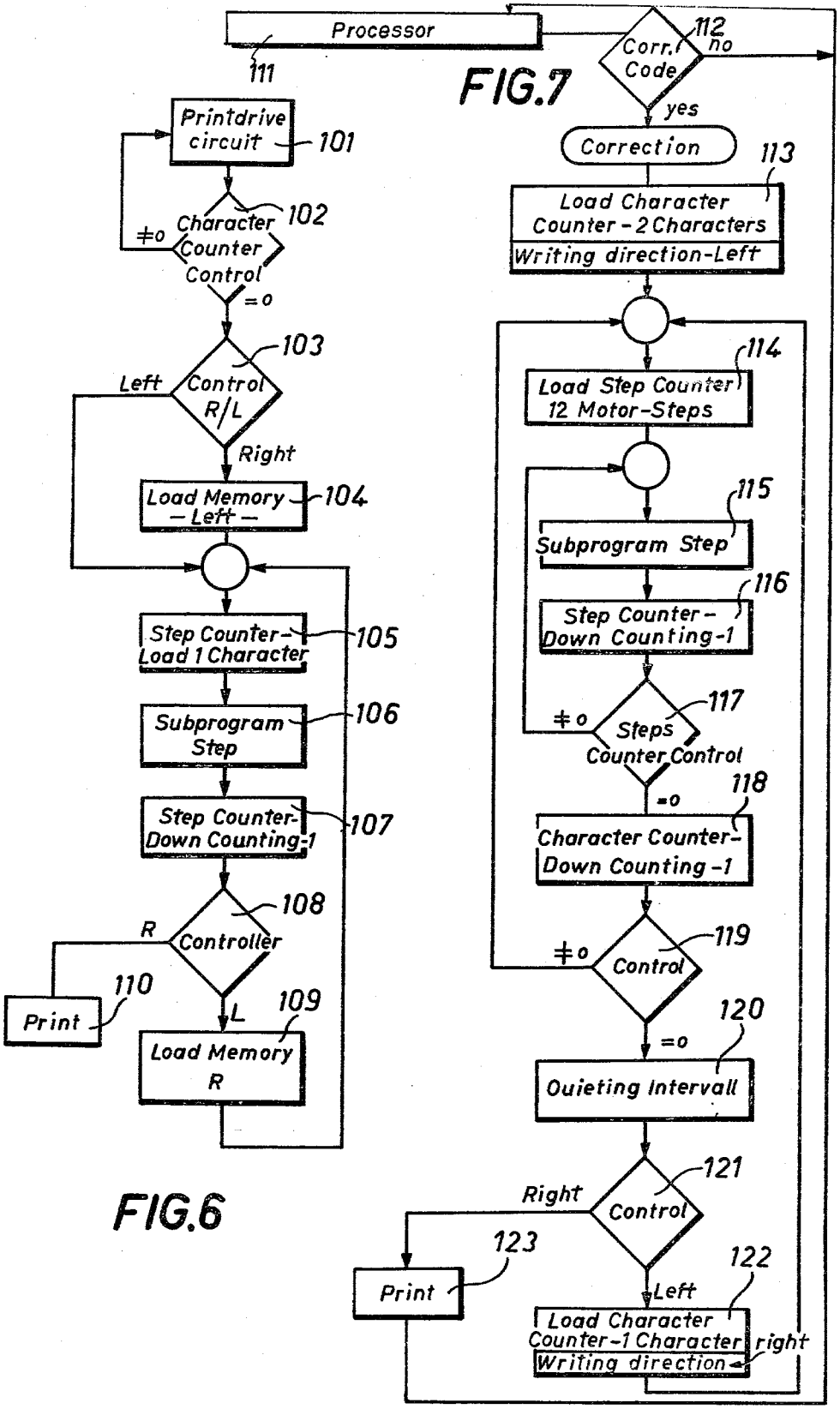
FIG. 6 comprise a flow diagram, of the program executed by the processor conformable to FIG. 4 and FIG. 7 comprise a flow diagram of the program executed by the processor conformable to FIG. 5.

FIG. 6 comprise a flow diagram of the program executed by the processor conformable to U.S. Pat. No. 4,030,591 and to FIG. 4. Referring to FIGS. 4 and 6, after the type wheel 29 is brought, from the old set position in the direction of arrow 67, into the printing position, the type wheel is caused to execute a pilgrim step movement conformable to flow diagram which will now be explained.

Block 101—The print drive circuit caused to bring the type wheel in the print position.

Block 102—When the logic level is "0," a signal is transferred to controller 103.

Block 103—The signal "Right" indicates the memory 104 to load "left"

Block 104—The memory 104 transferred a signal to step counter 105.

Block 105—The step counter 105 determines how far the motor 43 drives the type wheel in the arrow 69.

Block 106 and 107—If the step counter is down counted, a signal is transferred to the controller 108.

Block 108—The controller 108 transfers a signal "L" to memory 109.

Block 109—This memory 109 causes the step counter 106 to load for 1 character. The subprogram step 106 drives the motor 43 in the arrow 71. The steps in the arrow 69 and in the arrow 71 are equal.

Block 110—If the type wheel has been brought back in the printing position, the controller 108 transfers a signal "R" to print drive circuit.

If the type wheel has been brought into the printing position in the direction of arrow 73, the controller 103 transferred a signal "Left" to the step counter 105. Then the flow in the diagram is the same as above described. The type wheel 29 thereafter performs the same pilgrim step movement in the direction of 75 and 77.

For a possibly required correction process. FIG. 1 shows a procedure in which the processor 111 transfers a signal to controller 112 which sends a correction code to character counter 113. This character counter 113 was loaded for two characters in writing direction of arrow "left". Then a signal is transferred to step counter 114. This counter 114 was loaded for 12 motor steps. The subprogram step 115 and the down counting in Block 116 cause the step counter to decrement to zero. When the step counter reaches zero count, the controller 117 emits a pulse to character counter 118. When the character counter 118 also reaches the zero count, there is a short quieting intervall. Then a pulse is emitted to controller 121 which transfers a signal to character counter 122. This character counter 122 is loaded for 1 character in the writing direction of arrow "right" and emits a pulse to load step counter 114. Then the step counter and the character counter are brought to the zero count. After the quieting intervall the controller 121 emits a signal "Right" to the print drive circuits 123. This block 123 transfers a signal to the chief program in the processor 111. Accurate positioning of the carriage 13 is given by the above described flow diagram and the processor 111 as known through the U.S. Pat. No. 4,030,591.

It will be understood that the above description of the present invention is susceptible to various modifications, changes and adaptations, and the same are intended to be comprehended within the meaning and range of equivalents of the appended claims.

What is claimed is:

1. A printer for use in an office machine having a keyboard, said printer serving to produce neatly printed material and comprising: a carriage; a carriage drive supporting said carriage for movement along a line printing path; a typing element carrying type faces of the characters to be printed and movably mounted on said carriage; a typing element drive motor connected to said typing element and controllable from the keyboard for displacing said typing element in steps to bring a selected type face into a printing position; a type striking device positioned to act on the type face in the printing position to effect printing of the associated character on a record carrier medium; and a control device connected to receive signals from the keyboard, to derive therefrom driving pulses identifying each character to be printed, and to transmit those driving pulses to said typing element drive motor for bringing successive selected type faces to the printing position, said control device being operative, immediately after each movement of said typing element to bring a type face into the printing position and before printing of the associated character, for applying to said drive motor at least one driving pulse for displacing said typing element in a predetermined direction over a path of predetermined length and thereafter at least one driving pulse for displacing said typing element in the direction opposite to the predetermined direction and over a path of the same predetermined length, whereby, prior to each printing operation, said typing element performs a movement having a fixed pattern.

2. An arrangement as defined in claim 1 wherein said typing element is fixed to the output shaft of said drive motor and said control device is a microprocessor operative to cause each successive movement of said typing element to be effective over the shortest possible path from the previous position thereof.

3. An arrangement as defined in claim 2 wherein said typing element drive motor is a stepping motor.

4. An arrangement as defined in claim 1 wherein said typing element drive motor is a stepping motor.

5. An arrangement as defined in claim 1, 2, 3 or 4 further comprising a correcting device actuatable by a correction key on the office machine keyboard and including a lift-off tape for removing a previously printed character by applying the type face of that character to the record carrier medium with the lift-off tape interposed therebetween, and wherein said control device is connected for supplying drive pulses to said carriage drive, each pulse being effective to displace said carriage by one step along the line printing path, with one direction of displacement being the normal line printing direction, and, for removing a printed character, said control device is arranged to displace said carriage to a location one step removed from the location of the character to be removed in the line printing direction and, upon subsequent actuation of the correction key, to supply a given number of drive pulses to said carriage drive for displacing said carriage by a corresponding number of steps opposite to the line printing direction and to then supply to the said carriage drive at least one drive pulse one less in number than the given number for displacing said carriage in the line printing direction to the location of the character to be removed, prior to application of the type face to the carrier medium, whereby, prior to each lift-off operation, said carriage performs a movement having a fixed pattern.

6. An arrangement as defined in claim 5 wherein said carriage drive comprises a carriage drive stepping motor.

7. An arrangement as defined in claim 6 wherein said carriage drive further comprises a toothed belt connected to said carriage and to be driven by said carriage drive stepping motor.

8. A method for operating the printer defined in claim 1, installed in an office machine, comprising, before actuating said type striking device: bringing a selected type face into the printing position; and then applying at least one driving pulse to said drive motor for displacing said typing element in the predetermined direction over the path of predetermined length and then applying at least one driving pulse to said drive motor for displacing said typing element in the direction opposite to the predetermined direction and over the path of the same predetermined length.

9. Method as defined in claim 8 in which printing is effected by moving said carriage in a printing direction along the line printing path and said printer further includes a correction device actuatable by a correction keey on the office machine keyboard and including a lift-off tape interposable between the type face of a character to be removed and the record carrier medium, said method comprising lifting-off a character which has been printed by the steps of: actuating a backup key on the office machine keyboard to cause said carriage drive to move said carriage along said line printing path in the direction opposite to said printing direction to a position spaced a predetermined incremental distance in the printing direction from the position for printing the character to be lifted off; and then, in response to actuation of the correction key and prior to effecting lift-off of the character, causing said carriage to move along said line printing path in the direction opposite to said printing direction through a distance equal to a first selected multiple of the incremental distance and then in the said printing direction through a distance equal to a second selected multiple of the incremental distance, with the second multiple having a value one less than the first multiple, to the position for printing the character to be removed, whereby, prior to each lift-off operation, said carriage performs a movement having a fixed pattern.

* * * * *